United States Patent [19]

Thompson

[11] 4,111,729

[45] Sep. 5, 1978

[54] INHIBITED SOLID PROPELLANT COMPOSITION CONTAINING BERYLLIUM HYDRIDE

[76] Inventors: T. O. Paine, Administrator of the National Aeronautics and Space Administration, with respect to an invention of Wallace W. Thompson, Los Angeles, Calif.

[21] Appl. No.: 849,274

[22] Filed: Aug. 5, 1969

[51] Int. Cl.[2] ..... C06B 45/10

[52] U.S. Cl. ..... 149/19.9; 149/19.92; 149/20

[58] Field of Search ..... 149/19, 20, 19.9, 19.92

[56] References Cited

U.S. PATENT DOCUMENTS

| | | | |
|---|---|---|---|
| 3,035,948 | 5/1962 | Fox | 149/19 |
| 3,087,844 | 4/1963 | Hudson et al. | 149/19 |
| 3,094,444 | 6/1963 | Hedrick et al. | 149/19 |
| 3,215,573 | 11/1965 | Winkler | 149/19 X |
| 3,305,523 | 2/1967 | Burnside | 149/19 X |
| 3,476,622 | 11/1969 | Harada et al. | 149/19 |

*Primary Examiner*—Edward A. Miller

*Attorney, Agent, or Firm*—John H. Warden; G. T. McCoy; Monte F. Mott

[57] ABSTRACT

A small amount of lecithin inhibits the reaction of beryllium hydride with the acid groups in carboxy terminated polybutadiene.

5 Claims, No Drawings

INHIBITED SOLID PROPELLANT COMPOSITION CONTAINING BERYLLIUM HYDRIDE

ORIGIN OF THE INVENTION

The invention described herein was made in the performance of work under a NASA contract and is subject to the provisions of Section 305 of the National Aeronautics and Space act of 1958, Public law 83-568 (72 Stat. 435; 42 USC 2457).

BACKGROUND OF THE INVENTION

1. Field of the Invention

This invention is in the field of propellants. More particularly, the invention relates to solid propellant compositions utilizing beryllium hydride as a fuel.

2. Description of the Prior Art

For some time it has been known that beryllium can be utilized as a metal fuel additive in solid propellant formulations. In more recent years, beryllium hydride has been utilized rather than beryllium because it provides the highest theoretical impulse of any known fuel when associated with a wide variety of oxidizers.

One of the more recent and prevalent forms of beryllium hydride utilized in composite solid propellants is BEANE which is produced by the pyrolysis of beryllium alkyls. BEANE has the general formula:

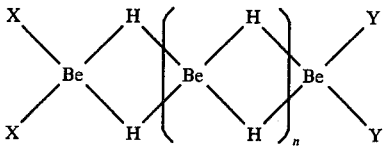

wherein:

- $n$ varies from 10 to about 250 depending on the degree of pyrolysis of the beryllium alkyl, and
- X and Y can be individually selected from H or R where R is a lower alkyl group of one to four carbon atoms.

BEANE has an intrinsic low density of approximately 0.65 gram/cc. As a result, the material has a large specific volume and surface and thus it is very difficult to obtain high solids loading in solid propellant formulations. One method that has been recently discovered for improving the solid loading capability of the BEANE is to coat the beryllium hydride particles with a fused solid oxidizer composition. The oxidizer coated BEANE particles can then be subsequently incoporated into a composite propellant formulation which could contain from 15 to 25 weight percent BEANE and from 15 to 20 weight percent binder, the remaining being the oxidizer. However, even with the new approach of coating the BEANE with the oxidizer, another major problem remained unsolved.

One of the most prevalent and popular candidates for a binder to be utilized in composite solid propellants incorporating BEANE or beryllium hydride is carboxy-terminated polybutadiene, CTPB. The beryllium hydride, even when coated with an oxidizer, reacts with the acid group of the carboxy-terminated polybutadiene, releasing free hydrogen and precipitating beryllium salts in the polymer. This has severely limited and affected the use of beryllium hydride with carboxy-terminated polybutadiene which otherwise is an excellent binder candidate.

OBJECTS AND SUMMARY OF THE INVENTION

An object of this invention is to provide a composition of beryllium hydride and carboxy-terminated polybutadiene which is stable.

Another object of this invention is to provide a method for inhibiting the reactivity of beryllium hydride toward carboxy-terminated polybutadiene.

The above and other objects of this invention are accomplished by incorporating a small amount of lecithin in propellant formulations containing beryllium hydride and carboxy-terminated polybutadiene.

DESCRIPTION OF THE PREFERRED EMBODIMENTS

Lecithin, a well known surface active wetting agent, has been previously utilized in polyurethane propellants in that capacity and aids in the reduction of viscosity of the propellant so that it can be more easily mixed or blended. In attempting to formulate propellant compositions of BEANE with carboxy-terminated polybutadiene as a binder, it was found desirable to reduce the viscosity of the mixture so that it could be more readily formulated into a propellant during the mixing process. As a result, initial effort was directed toward selecting known surface active agents which would aid in this processability. Because of the previous use of lecithin in the polyurethane propellants, as indicated, the material became one of the candidates investigated.

In utilizing lecithin with BEANE and carboxy-terminated polybutadiene, surprisingly it was found that there was very little reduction in viscosity of the mixture. In other words, lecithin did not serve as a successful wetting or surface active agent in this composition.

Concurrent with the problem of processability mentioned above, it was noted in attempting to formulate propellant compositions of BEANE and carboxy-terminated polybutadiene that the beryllium hydride appeared to react with the acid groups in the CTPB to give free hydrogen and beryllium salts of the polymer. Obviously, this results in a degradation of both the binder and the beryllium hydride components. Further, a significant increase in viscosity of the mixture can result due to the reaction and the porosity of the mixture is affected due to the gas bubbling therethrough. In view of this, serious doubts arise concerning the feasibility of incorporating BEANE into CTPB binder material. One particular disclosed method of utilizing BEANE successfully is to previously coat the beryllium hydride particles with a melt of an oxidizer or oxidizer combination. Thus, BEANE has been successfully coated with hydrazine nitrate or a mixture of hydrazine nitrate and either ammonium nitrate or ammonium perchlorate. The coated BEANE particles are then mixed into the propellant binder to formulate the final product. However, even the BEANE that had been coated with the oxidizer was found to be reactive with carboxy-terminated polybutadiene in the same manner previously described above.

Since lecithin was a well known surface active agent which had been previously utilized in polyurethane propellant formulations to aid processability, an attempt was made to utilize it with propellant formulations described herein. However, the lecithin did not significantly affect the viscosity of propellant mixtures containing BEANE and carboxy-terminated polybutadiene. In other words, the lecithin did not perform the function that it had previously performed when incorporated in polyurethane propellants.

Unexpectedly, however, the lecithin, though it did not improve the processability of the propellants described herein, did prove to serve a very important function, namely, the lecithin was found to inhibit the reaction of the beryllium hydride with the acid groups of the carboxy-terminated polybutadiene. This thus permitted production of homogenous mixture of propellant without significant degradation. The amount of lecithin required to inhibit the reaction is less than 0.5 weight percent of the total propellant composition. Thus, it can be seen that the lecithin did not serve to perform its previously known function, but rather acted in a totally unexpected manner which had no relation to it being a wetting or surface active agent. It is believed that the invention will be further understood from the following specific examples:

EXAMPLE I

Sixty grams of hydrazine nitrate was melted and mixed with 40 grams of BEANE in an all Teflon rod mill while cooling below the melting point of the hydrazine nitrate. The resulting granular mixture was screened to provide coarse ($> 400\mu$), medium ($50–400\mu$), and fine ($<50\mu$), fractions and then recombined to form a trimodal blend consisting of 40 weight percent coarse, 40 weight percent medium, and 20 weight percent fine. Eighty grams of the trimodal blend were mixed with 12 grams of a carboxy terminated polybutadiene, 4 grams of dioctyl azelate, and 4 grams of a purified mineral oil. The resulting mixture was placed under vacuum to remove most of the occluded gases and finally extruded through 0.1 inch slits under vacuum to complete mixing and insure no occluded gases. The product was a smooth, slowly flowing, viscous, tacky mixture which, on standing for one to seven days, increased in volume, became porous, crumbly, together with losing its tack and ability to flow even under pressure.

EXAMPLE II

Eighty grams of the same hydrazine nitrate-BEANE mixture were formulated with the same carboxy terminated polybutadiene and plasticizers as shown in Example I, with the addition of 0.5 grams lecithin. The product retained its ability to flow under pressure and exhibited no gassing as no porosity was observed. The viscous, tacky material retained its consistency even after several months of storage.

What is claimed is:

1. A solid composition of matter comprising:
carboxy terminated polybutadiene,
beryllium hydride,
and an amount of lecithin sufficient to inhibit any reaction between said beryllium hydride and said carboxy terminated polybutadiene during storage of the composition prior to ignition thereof.

2. A solid propellant composition comprising:
from 15 to 20 weight percent carboxy terminated polybutadiene as a binder,
from 15 to 25 weight percent of beryllium hydride,
an amount of lecithin sufficient to inhibit reaction between said beryllium hydride and said carboxy terminated polybutadiene during storage of the propellant prior to ignition thereof,
and the remainder being a suitable oxidizer.

3. The propellant of claim 2 wherein said lecithin comprises less than 0.50 weight percent of said propellant composition.

4. The propellant of claim 3 wherein said oxidizer is selected from the group consisting of hydrazine nitrate, a mixture of hydrazine nitrate and ammonium nitrate, and a mixture of hydrazine nitrate and ammonium perchlorate.

5. In a method of formulating propellant by mixing beryllium hydride with carboxy terminated polybutadiene, the improvement which comprises:
mixing with said propellant an amount of lecithin sufficient to inhibit reaction between said carboxy terminated polybutadiene and said beryllium hydride during storage of the propellant prior to ignition thereof.

* * * * *